US005547169A

United States Patent [19]

Russell

[11] Patent Number: 5,547,169

[45] Date of Patent: Aug. 20, 1996

[54] FENCE ASSEMBLY WITH SWIVEL BRACKET

[75] Inventor: William C. Russell, Lutherville, Md.

[73] Assignee: The Anchor Group, Baltimore, Md.

[21] Appl. No.: 338,813

[22] Filed: Nov. 10, 1994

[51] Int. Cl.[6] ..... E04H 17/14; F16C 11/00; F16D 1/12

[52] U.S. Cl. ..... 256/67; 256/65; 256/59; 256/DIG. 2; 403/91; 403/87

[58] Field of Search ..... 403/90, 91; 256/65, 256/59, 67, 24, 26

[56] References Cited

U.S. PATENT DOCUMENTS

| | | | |
|---|---|---|---|
| 1,772,159 | 8/1930 | Roth . | |
| 4,150,907 | 4/1979 | Thurnauer . | |
| 4,156,522 | 5/1979 | Snowden et al. | 256/67 |
| 4,923,176 | 5/1990 | Heinz . | |
| 5,437,433 | 8/1995 | Rezek | 256/59 X |

*Primary Examiner*—Brian K. Green

*Assistant Examiner*—Bruce A. Lev

*Attorney, Agent, or Firm*—Rothwell, Figg, Ernst & Kurz

[57] ABSTRACT

A fence assembly including posts and rails connected to each other by adjustable connecting members. The connecting member is a swivel bracket which permits adjustment of an end of the fence rail relative a fence post in various directions, e.g., in vertical and horizontal planes. The swivel bracket includes a base member and a body member, and the base member preferably has a flat side configured to be secured against the outer surface of a fence post. The opposite side of the base has a rounded concave depression adapted to receive one end of the bracket body member, the body member having a rounded exterior which fits within said depression. The body member has a hollow chamber therein which is open at a side thereof to receive the end of the rail. The ends of the rail are received in the bracket body chambers through the opening therein and then fixed to the brackets. Thus, it is possible to first set two fence posts, fix the swivel brackets to the posts at the desired angular position, and then secure a rail to the posts in butt-joint fashion.

17 Claims, 4 Drawing Sheets

FENCE ASSEMBLY WITH SWIVEL BRACKET

BACKGROUND OF THE INVENTION

1. Field of the Invention

The present invention relates to a fence assembly including a swivel bracket in which the fence rails are adjustable and may be mounted at any of various angular orientations to the fence posts. More particularly, the invention permits the fence posts to be set in the ground, or another suitable support surface, and a fence rail then is inserted between posts via an opening in the swivel brackets.

2. Description of Relevant Art

It is known in the prior art to secure a rail member to a vertical post in an adjustable manner, i.e., to select a particular angle between the rail and post and secure the rail at that position. For example, U.S. Pat. No. 1,772,159 discloses a stair rail connection in which a spherical connecting member is disposed between the balusters and the hand rails to allow the angle of connection therebetween to be varied.

It also is known to construct a fence in which the rails may be adjusted angularly relative the vertical fence posts. U.S. Pat. No. 4,923,176 discloses a fence connector assembly including a bracket that is received over a fence post, the bracket having oppositely directed pairs of flanges. Between each pair of flanges is secured a U-shaped swivel bracket that forms a pocket which receives the end of a fence rail. By swivelling the bracket in the horizontal plane, the angular orientation of the fence rail relative the fence post can be changed within the horizontal plane. The swivel bracket in the 4,923,176 patent, however, does not permit angular adjustment of the fence rail in other planes.

U.S. Pat. No. 4,150,907 discloses a stanchion connector assembly with a ball and socket type connection including a sleeve member received in the rail member and a mating spherical portion affixed to the stanchion. The rail and sleeve member may be angularly adjusted relative to the stanchion to fix the rail at the desired angular orientation. The sleeve member includes a cylindrical collar and a curved plate welded thereto. Although the aforementioned patents disclose rail systems in which the rail may be adjustably positioned and then fixed to the support post, several shortcomings are present in such systems.

In the construction of fencing, workers often will set, i.e., fix the position of a vertical fence post in the ground, on a cement support surface, etc., and then secure an end of the transverse fence rail thereto. With an end of the fence rail secured to the fixed post, the next post is set and the opposite end of the fence rail is secured to the second post. The end of a second fence rail then is secured to the second fence post, a third post is set, and the opposite end of the second rail then is secured to the third post, etc. In this manner, the workers move along the length of the fence setting posts and securing the rails between the pairs of adjacent posts.

One problem with the above approach is that it requires placement of the rail between the two adjacent fence posts in order to fix the position of the second post. That is, it is not possible to fix the position of all the posts and then secure all the rails to the already fixed posts. This is because the respective components cannot be placed in a butt joint relationship with the fixed posts. As such, the rails must be selectively positioned and secured to adjacent posts in series-like fashion along the length of the fence. Accordingly, it is not possible with such systems for a crew to first set all of the fence posts, for example, while the rail sections are being fabricated in the shop. Thus, known fence or rail systems impose limits on the flexibility and freedom in which the systems may be constructed or installed.

Another problem with the above-described fence systems is that the adjustability of the rails relative to the fence posts is relatively limited, and the attachment apparatus includes several components. In addition, the range of adjustability between the rail and posts of prior art fencing often detracts from the aesthetics of the fence due to, e.g., slots, bolts, etc., being visible in the completed assembly.

Accordingly, there remains a need in the art for a fence system which is easy to construct, provides improved flexibility in its installation, provides a wide range of adjustability of the rails with respect to the posts, and has an overall aesthetically pleasing appearance.

SUMMARY OF THE INVENTION

The present invention provides a fence assembly including posts and rails connected to each other by adjustable connecting members. The connecting member is a swivel bracket which permits adjustment of an end of the fence rail relative a fence post in various directions, e.g., in vertical and horizontal planes. In a preferred embodiment, the swivel bracket includes two main components, namely, a base member and a body member. The base member preferably has a flat side configured to be secured against the outer surface of a post, which typically will be fixed in a vertical position. The opposite side of the base preferably has a rounded concave depression adapted to receive one end of the bracket body member, the body member having a rounded exterior which fits within said depression.

The body member of the swivel bracket has a hollow chamber therein which preferably is open at the top to receive the end of the rail. Thus, two brackets may be secured to two respective, previously-set fence posts at a desired angular orientation, and the fence rail thereafter secured to and between the posts. The ends of the rail are received in the bracket body chambers through the opening therein and then fixed to the brackets. In this manner, it is possible to first set the plurality of fence posts, fix the swivel brackets to the posts at the desired angular position, and then secure the rails to the posts.

BRIEF DESCRIPTION OF THE DRAWINGS

Other features, benefits and advantages of the present invention will be apparent from the following detailed description of preferred embodiments thereof taken in conjunction with the accompanying drawings wherein.

DETAILED DESCRIPTION OF PREFERRED EMBODIMENTS

Figure 1:
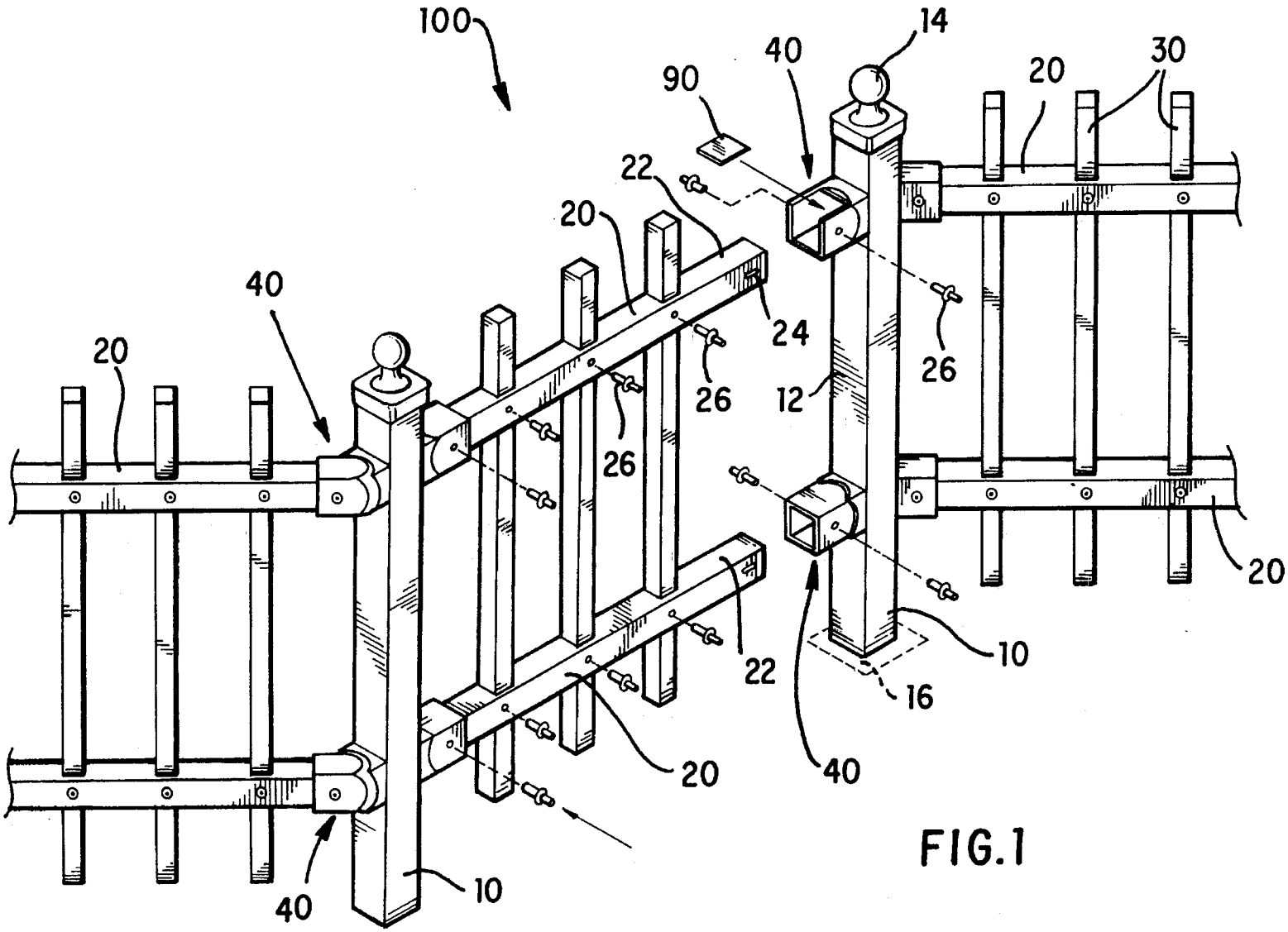
FIG. 1 is a partially exploded, perspective view showing a fence assembly constructed according to the present invention.

With reference to FIG. 1, a fence assembly constructed according to the present invention is shown in partly exploded fashion and is indicated generally by the reference numeral 100. The fence assembly 100 includes a plurality of fence posts 10 and a plurality of fence rails 20 mounted thereto. FIG. 1 shows two fence posts 10 with a fence section extending therebetween (the section unattached to the post 10 on the right). The fence posts 10 have an outer surface 12 and, as is known in the art, post caps 14 are provided to close off the top of the posts. The bottom portion of the posts 10 are set, i.e., fixed in or to the ground or other support surface, as indicated schematically at 16. In addition, pickets 30 are attached to and extend between the rails 10.

A plurality of fence rails 20 extend between the fence posts 10 and, in the embodiment of FIG. 1, two rails 20 connect adjacent posts 10. The position of a fence post 10 typically will be vertical or substantially vertical with the support surface contour or layout dictating the relative orientation of two adjacent posts 10. That is, for example, one post may be higher than the adjacent post and, consequently, the fence rail extending between the posts will be angled. The adjustment of the angular position of the rail 20 is facilitated by the swivel brackets 40 described in detail below.

The fence rails 20 have opposite ends 22 with a slot 24 therein for receiving a fastener as explained below. The fasteners may be any suitable attachment device, and in a preferred embodiment are rivets. The rivets also attach the pickets 30 to the rails 10. One feature of the present invention is the ability to position the rails 10 in the swivel brackets 40 after the posts 10 have been set. This is because the ends of the rails, as viewed in the exploded portion of FIG. 1, can be dropped into the open top of the swivel bracket 40 to form a butt-like joint between the rail and posts. The fasteners then are passed through corresponding openings provided in the bracket 40 and rail 10.

Figure 3:
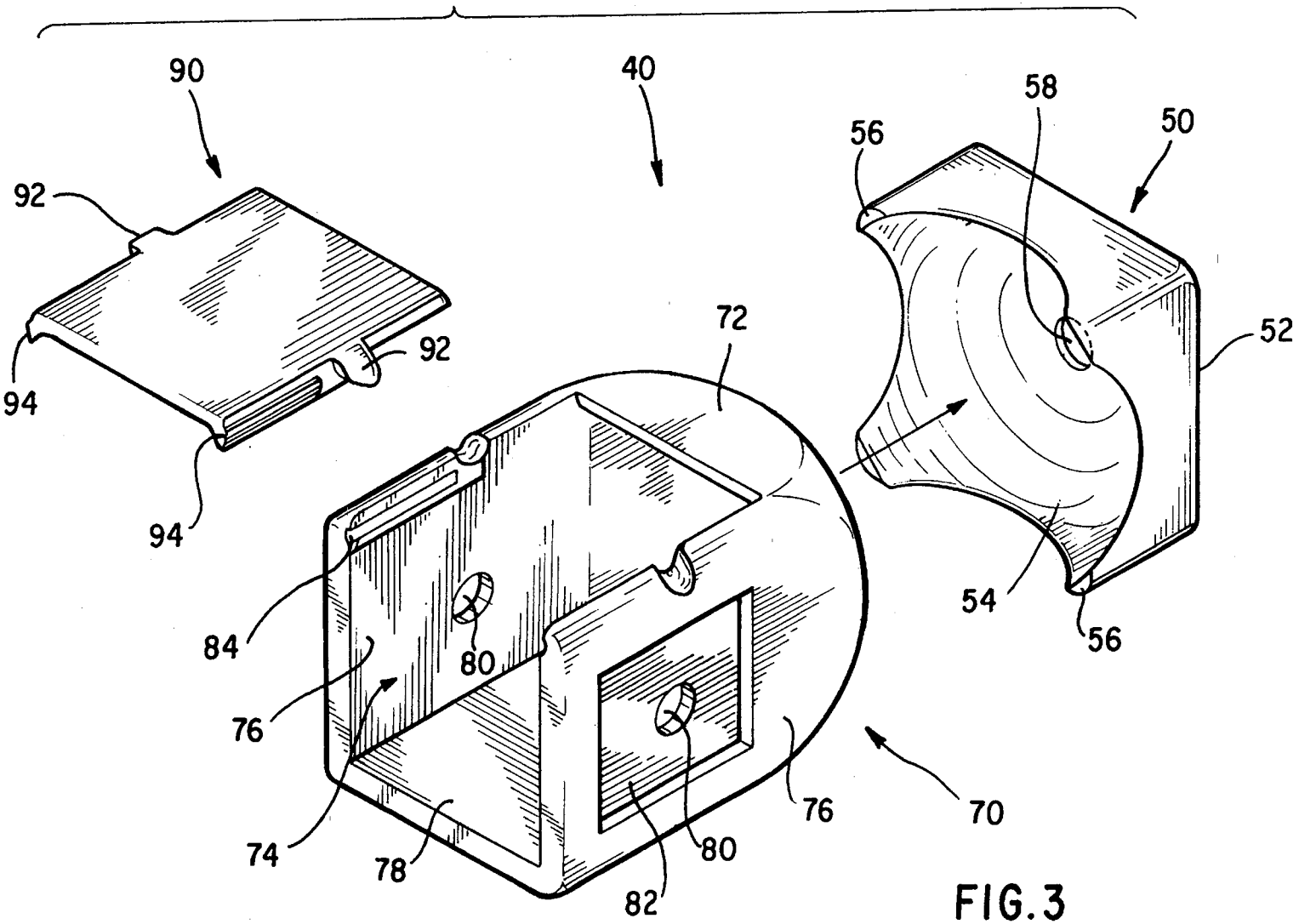
FIG. 3 is an exploded perspective view of the swivel bracket of the present invention.

The swivel bracket 40 is shown in detail in FIGS. 3 and 4A–4C. Referring to FIG. 3, bracket 40 preferably includes two main components, base member 50 and body member 70. Base member 50 has a first end 52 which may be a flat surface for being mounted against a flat support surface. Opposite the end 52 a rounded concave depression 54 is provided and extends to the edges 56 of the base 50. A central aperture 58 and a plurality of removable areas 60 (FIG. 4C) are formed in the base 50 for reasons described below.

The bracket 40 includes a body member 70 having an end with a rounded exterior 72 and a hollow chamber 74, the chamber 74 being open at the top as seen in FIG. 3. Reference to the chamber 74 having an open top is for exemplary sake only as it will be appreciated that the open side of the chamber 74 could be located at other portions thereof. The chamber 74 is defined by side walls 76 and a bottom wall 78. Openings 80 are provided in the side walls and receive fasteners that secure the end of the rail 10 to the body member 70 of bracket 40. The openings 80 may be formed in a recessed portion 82 of the side walls 76 as shown in FIG. 3.

A cap member 90 is configured to be locked to the body member 70 to close off the chamber 74 and capture the end of the fence rail 20 therein. The cap 90 preferably has a pair of ears 92 extending from opposite side edges and a rib 94 which cooperates with grooves 84 formed in the bracket body in a snap-fit manner to lock the cap 90 to the body 70. In a preferred embodiment the cap 90 is locked to the bracket 40 so as to be nonremovable.

Figure 2B:
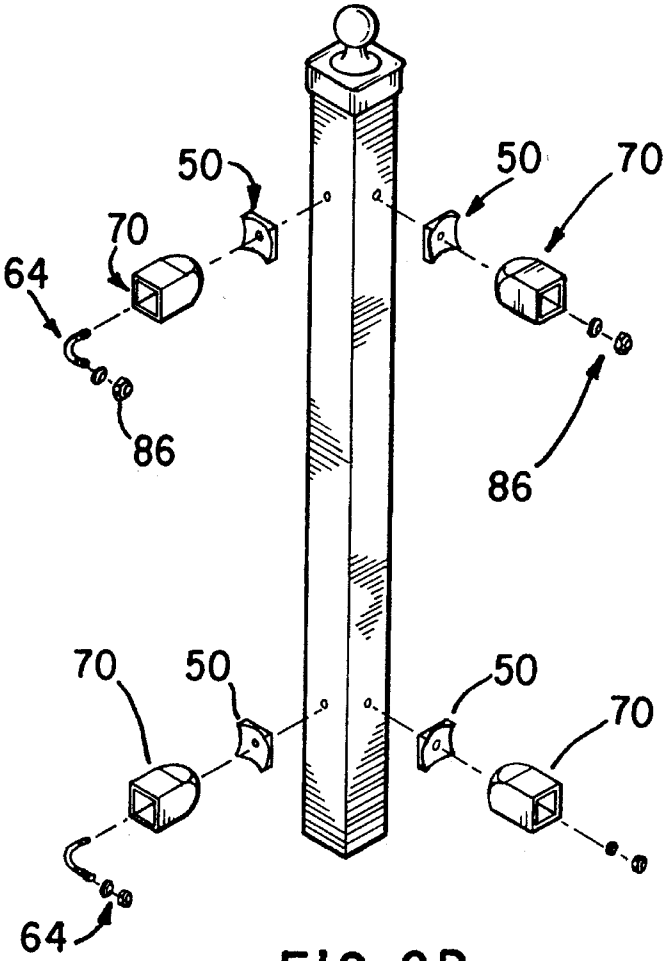
FIGS. 2A and 2B are, respectively, exploded perspective views of the fence system of the present invention in exemplary straight path and corner applications.
Figure 2A:
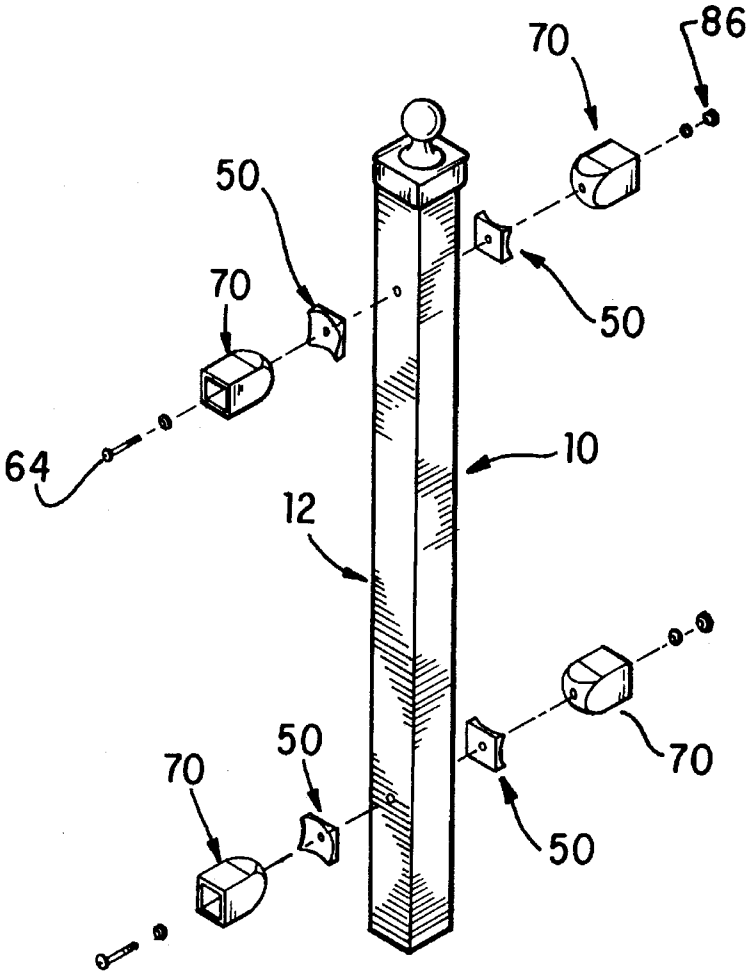

FIGS. 2A and 2B show possible applications of the present invention in which a fence post 10 has four brackets 40 mountable thereon. FIG. 2A shows a construction in which the rails (not shown) extend away from the post 10 in a straight manner such that the fence rails are collinear. FIG. 2B, on the other hand, show a bracket arrangement in which the rails extend away from the post 10 such that the fence rails form a right angle. The bracket 40 is secured to the post 10 by a bolt 64 passing through the bracket body, base, and post, and a locking nut and washer assembly 86 attached thereto. As seen in FIG. 2B, a double ended curved bolt 64 may be used for the corner application with nut and washers 86 securing the brackets 40 to the adjacent surfaces of the post 10.

Figure 4C:
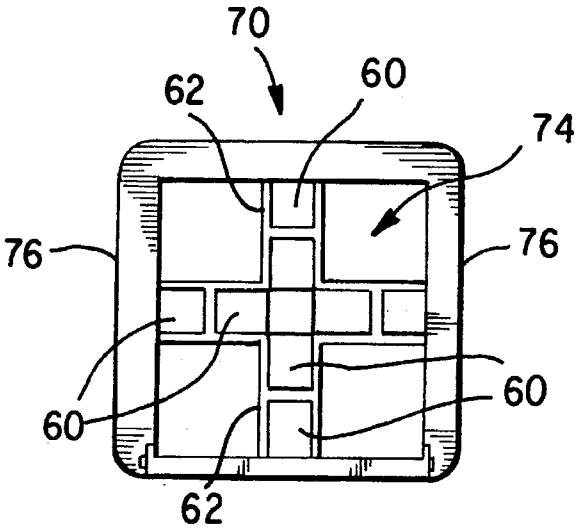
FIGS. 4A, 4B and 4C are, respectively, plan, side elevation, and rear elevation views of the swivel bracket shown in FIG. 3.
Figure 4B:
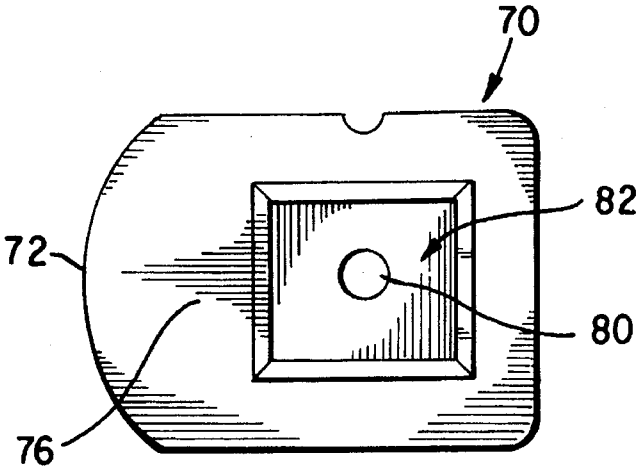
Figure 4A:
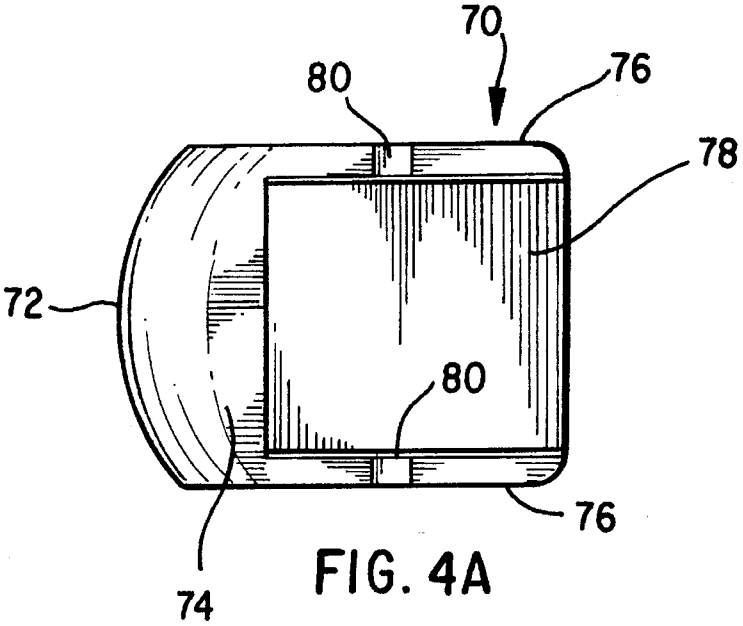

In use, the fence posts 10 can be set in the ground, and the brackets 40 secured to the posts via a bolt 64 and a lock nut and washer assembly 86. The desired angular position of the body 70 relative the base 50 of each bracket 40 is determined and the bracket body then is fixed to the base. As described above, the body member 70 is adjustable by pivoting the rounded exterior 72 within the concave depression 54 of the base member. The body 70 can be pivoted along either horizontal or vertical axes. FIGS. 4A–4C show plan and elevation views of the bracket body member 70. As seen in FIG. 4C, which is a view looking into the hollow chamber 74, the rounded exterior 72 preferably has a central aperture 58 and a plurality of removable sections 60, the sections 60 being defined by weakened areas in the form of grooves 62. Depending on the desired angular position of the body member 70, an appropriate portion of the body member 70 may be punched out to accommodate the fastener which secures the body 70 to the base 50. The removable portions of the body 74 in FIG. 4C form a cross to provide for adjustment along either horizontal or vertical axes. Those skilled in the art, of course, will recognize that additional removable areas, or removable areas at different locations on the body, etc., are possible as well. The bracket body 70 may be formed of zinc diecast which provides a rigid structure yet permits the removable sections to be punched out, although other materials may be used. The same material may be used for the other bracket components as well.

In addition to permitting a multitude of adjustments between the bracket body and the bracket base to accommodate a wide range of fence configurations, the present invention provides great flexibility in construction of the fence assembly due to the ability to first set the fence posts and attach the swivel brackets thereto. The open-top chamber of the swivel bracket allows the end of the fence rail to be moved into the affixed bracket in a direction substantially along the length of the fence post, as opposed to moving the end toward the post in butt joint fashion (which requires that the second post be set after the end of the rail is fixed to the first post). Accordingly, construction of a fence assembly according to the present invention is greatly improved over prior art fence systems.

Although the present invention has been described with reference to particular embodiments, it is to be understood that the embodiments are merely illustrative of the application of the principles of the invention. Numerous configurations may be made therewith without departing from the spirit and scope of the invention.

What is claimed is:

1. A fence assembly kit comprising:

at least one fence post having an outer surface;

at least one fence rail configured for adjustable securement to the fence post, the fence rail including two ends with one of the two ends attachable to the outer surface of the fence post after being adjusted along either of horizontal and vertical pivot axes;

a swivel bracket attachable to the outer surface of the fence post and to the one end of the fence rail for facilitating pivotal adjustment of the fence rail relative to the fence post along either of said two pivot axes and for securing the fence rail to the fence post, the swivel bracket including:

a base member having a first end for securement to the outer surface of the fence post and a second end defining a rounded depression;

a pivotable body member having a rounded exterior portion configured to be received in the depression of the base member to permit adjustment of the body member, and a plurality of generally flat walls defining a hollow chamber having an entry opening configured to receive the one end of the fence rail;

wherein the first end of the base member of the swivel bracket is securable to the outer surface of the fence post with the rounded portion of the pivotable body member placed in the depression of the base member at a desired angular position and then secured thereto;

whereby the one end of the fence rail may thereafter be positioned in the chamber of and secured to the pivotable body member to fix the fence rail to the fence post at the desired position.

2. A fence assembly kit according to claim 1, wherein the pivotable body member includes a plurality of generally flat side walls and a generally flat bottom wall that form the hollow chamber and define said entry opening which receives and supports the one end of the fence rail therein.

3. A fence assembly kit according to claim 2, wherein the chamber is U-shaped and is defined by two side walls and the bottom wall, and said entry opening is located opposite the bottom wall and between the two side walls to permit the end of the fence rail to be inserted into the chamber after the fence post is fixed in position.

4. A fence assembly kit according to claim 3, wherein a cap member is provided that is securable to the bracket body member to close off the entry opening of the chamber and enclose the end of the fence rail therein.

5. A fence assembly kit according to claim 4, wherein the cap is securable to the bracket body member by a snap fit engagement between a rib formed on the cap and a groove formed in at least one of the flat side walls of the chamber.

6. A fence assembly kit according to claim 2, wherein the generally flat side walls of the chamber include at least one opening for aligning with at least one opening formed in the end of the fence rail to receive a fastener which secures the fence rail to and within the chamber of the pivotable body member.

7. A fence assembly kit according to claim 6, wherein an opening is provided in each of two generally flat side walls of the chamber to mate with corresponding openings formed in the rail.

8. A fence post and rail system comprising:

a plurality of fence posts adapted to be secured to a support surface;

a plurality of fence rails secured to the fence posts with each rail extending transversely to and extending between two of the posts, each rail having two ends mounted at a desired angular position, respectively, to a pair of said fence posts, and each fence rail being adjustable to various angular positions along both horizontal and vertical axes relative the posts before being mounted to the posts, said adjustable mounting between the fence rails and the fence posts being facilitated by a plurality of swivel brackets each of which secures an end of a fence rail to a fence post at a desired position;

each of said swivel brackets including a base member secured to a fence post and having a rounded, concave depression which opens outwardly away from the fence post, and a body member configured to receive a fence rail, the body member having a rounded exterior which is positioned in the rounded, concave depression of said base member, and an open-sided hollow chamber in which the end of the rail is completely received to attach the rail to the bracket;

wherein the rounded exterior of the body member engages the rounded, concave depression of the base member with the position of the body member being adjustable in various directions relative the base member to adjust and then fix the body member therein;

whereby the fence rails can be secured to the fence posts at a desired angular orientation to accommodate variations in the positioning of the plurality of the fence posts on the support surface.

9. A fence assembly according to claim 8, wherein the hollow chamber is disposed adjacent the rounded exterior and an entry opening is provided in the body member through which an end of a fence rail is inserted into the chamber.

10. A fence assembly according to claim 9, further comprising a plurality of cap members configured for attachment to respective bracket body members to close off the entry opening of the hollow chamber and capture an end of a fence rail within said chamber.

11. A fence assembly according to claim 10, wherein each of said cap members includes a pair of ears configured to be received in notches formed in the body member, and at least one rib configured to be received in a groove formed in the body member, the rib and groove snap-fitting together to lock each cap member to a respective body member.

12. A fence assembly according to claim 9, wherein the body member of each bracket has an aperture through the rounded exterior to receive a fastener securing the body member to the base member, and the rounded exterior includes a plurality of removable sections defined by weakened areas in the body member to permit said sections to be punched-out to provide a plurality of locations to receive fasteners for connecting the body member to the base member at various angular positions.

13. An open-top swivel bracket for attaching an end of a fence rail to a vertical fence post, the open-top swivel bracket comprising:

a base member configured to be fixedly secured to the fence post;

a body member having a first end for being adjustably received in the base member with said first end pivotably mounted therein to permit adjustment of the position of the body member before attaching the base and body members together, the body having a chamber including an open top providing an entry into the interior of the body member, the chamber having a plurality of wall portions for receiving and surrounding the end of a fence rail when inserted through said open top into the interior of the body member;

a fastener for securing the base member to the bracket body member; and a cap member for being lockingly attached to the body member and closing off the open top of said chamber to capture the end of the fence rail within the interior of said body member when inserted therein.

14. An open-top swivel bracket according to claim 13, wherein the base member has a concave depression, and the exterior of the first end of the body member is rounded and received in the depression so as to be positionable and lockable at various angular positions.

15. A fence assembly according to claim 14, wherein the body member of each bracket has an aperture through the rounded exterior to receive a fastener securing the body member to the base member, and the rounded exterior includes a plurality of removable sections defined by weakened areas in the body member to permit said sections to be punched-out to provide a plurality of locations to receive fasteners for connecting the body member to the base member at various angular positions.

16. A fence assembly according to claim 13, wherein the cap is securable to the bracket body member by a snap fit engagement between a rib formed on the cap and a groove formed in at least one of the flat side walls of the chamber.

17. A fence assembly comprising:

at least one fence post having an outer surface;

at least one fence rail secured to the fence post, the fence rail including two ends with one of the two ends attached to the outer surface of the fence post after being adjusted along either of horizontal and vertical pivot axes;

a swivel bracket attached to the outer surface of the fence post and to the one end of the fence rail for facilitating pivotal adjustment of the fence rail relative to the fence post along either of said two pivot axes and for securing the fence rail to the fence post, the swivel bracket including:

a base member having a first end secured to the outer surface of the fence post and a second end including a rounded depression;

a pivotable body member including a rounded exterior portion received in the depression of the base member to permit adjustment of the body member relative to the base member;

wherein the pivotable body member includes a plurality of generally flat side walls that form a hollow chamber which receives and supports the one end of the fence rail; and wherein at least one of the flat side walls of the hollow chamber includes at least one opening aligned with at least one opening formed in the end of the fence rail and a fastener passes through the openings to secure the fence rail to and within the chamber of the pivotable body member; and wherein the first end of the base member of the swivel bracket is secured to the outer surface of the fence post and the rounded end of the pivotable body member is disposed in the depression of the base member at a desired angular position.

* * * * *

UNITED STATES PATENT AND TRADEMARK OFFICE

CERTIFICATE OF CORRECTION

PATENT NO. : 5,547,169

DATED : August 20, 1996

INVENTOR(S) : William C. Russell

It is certified that error appears in the above-indentified patent and that said Letters Patent is hereby corrected as shown below:

Col.1, line 47, after "set" insert -- a fence post --; Col. 2, line 40, "opening" should be -- openings --.

Signed and Sealed this

Twelfth Day of November, 1996

*Attest:*

*Attesting Officer*

Bruce Lehman

BRUCE LEHMAN

*Commissioner of Patents and Trademarks*